US009028279B2

(12) United States Patent
Chen et al.

(10) Patent No.: US 9,028,279 B2
(45) Date of Patent: May 12, 2015

(54) ELECTRICAL CONNECTOR HAVING IMPROVED RESILIENT CONTACT SO AS TO REALIZE BETTER RETAINING EFFECT

(71) Applicant: Hon Hai Precision Industry Co., Ltd., New Taipei (TW)

(72) Inventors: Yu-Hsu Chen, New Taipei (TW); Wei-Hung Hsu, New Taipei (TW); Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/052,921

(22) Filed: Oct. 14, 2013

(65) Prior Publication Data

US 2014/0106599 A1 Apr. 17, 2014

(30) Foreign Application Priority Data

Oct. 12, 2012 (TW) ..... 101219738 U

(51) Int. Cl.
*H01R 24/00* (2011.01)
*H01R 13/627* (2006.01)
*H01R 13/6582* (2011.01)

(52) U.S. Cl.
CPC ..... *H01R 13/6275* (2013.01); *H01R 13/6582* (2013.01)

(58) Field of Classification Search
CPC ..... H01R 24/58; H01R 17/12
USPC ..... 439/668, 675, 700
See application file for complete search history.

(56) References Cited

U.S. PATENT DOCUMENTS

| | | | | |
|---|---|---|---|---|
| 7,108,514 | B2 * | 9/2006 | Chen et al. | 439/63 |
| 8,079,880 | B2 | 12/2011 | Lin et al. | |
| 8,512,080 | B2 * | 8/2013 | Vroom et al. | 439/639 |
| 8,628,358 | B2 * | 1/2014 | Tung et al. | 439/668 |
| 2011/0159741 | A1 * | 6/2011 | Tung et al. | 439/660 |
| 2012/0322292 | A1 | 12/2012 | Li et al. | |

FOREIGN PATENT DOCUMENTS

| | | |
|---|---|---|
| TW | 299904 | 3/1997 |
| TW | M412509 | 9/2011 |

* cited by examiner

*Primary Examiner* — Phuongchi T Nguyen
(74) *Attorney, Agent, or Firm* — Ming Chieh Chang; Wei Te Chung

(57) ABSTRACT

An electrical connector includes an insulative housing, a plurality of first contacts arranged in a side-by-side manner, and a resilient contact retained in the housing. The housing defines a mating face, a blocking face and a mating cavity disposed between the mating face and the blocking face. Each first contact defines a first contacting portion projecting into the mating cavity. The resilient contact defines a blocking piece abutting against the blocking face, a retaining leg extending out of the mating cavity, and latching arms extending into the mating cavity from the blocking piece. The latching arms can be easily released from a mating connector so as to realize a better retaining effect.

16 Claims, 5 Drawing Sheets

ELECTRICAL CONNECTOR HAVING IMPROVED RESILIENT CONTACT SO AS TO REALIZE BETTER RETAINING EFFECT

BACKGROUND OF THE INVENTION

1. Field of the Invention

The present invention relates to an electrical connector, and more particular to an electrical connector equipped with an improved resilient contact which synchronously has locking and grounding functions so as to realize a better retaining effect.

2. Description of the Related Art

Taiwan Pat. No. 299904 issued on Mar. 1, 1997 discloses an electrical connector assembly including a plug connector and a receptacle connector. The socket connector includes a housing defining a mating cavity opening through a mating face and a plurality of contacts retained to the housing. The plurality of contacts includes a central contact which defines a contacting post projecting into the mating cavity and further adjacent to the mating face. The plug connector includes a contact having a U-shaped contacting portion which defines two separate contacting arms with a receiving room defined therebetween. When the plug connector is inserted into the mating cavity, the contacting post enters into the receiving room deeply and is gripped by the contacting arms steadily, thereby facilitating a perfect interconnection between the socket and plug connectors.

Since the contacting post is deeply inserted into the receiving room, the disengagement therefrom can only be done when the contacting post is in aligning with the socket. If the force used to pull the plug out of the socket is not perfect align with the insertion direction of the plug, the plug connector will be difficult to be remove therefrom. Therefore, a new design is required.

SUMMARY OF THE INVENTION

Accordingly, an object of the present invention is to provide an electrical connector equipped with an improved resilient contact having easily operated locking function while grounding function.

In order to achieve the object set forth, an electrical connector includes an insulative housing, a plurality of first contacts arranged in the housing in a side-by-side manner, and a resilient contact retained in the housing. The housing defines a mating face, a blocking face behind the mating face, and a mating cavity disposed between the mating face and the blocking face, the mating cavity communicates with an exterior via an insertion hole at a front end thereof. Each first contact defines a first contacting portion projecting into the mating cavity. The resilient contact defines a blocking piece abutting against the blocking face, a retaining leg extending out of the mating cavity, and latching arms extending into the mating cavity from the blocking piece.

Other objects, advantages and novel features of the invention will become more apparent from the following detailed description of the present embodiment when taken in conjunction with the accompanying drawings.

DETAILED DESCRIPTION OF THE INVENTION

Figure 1:
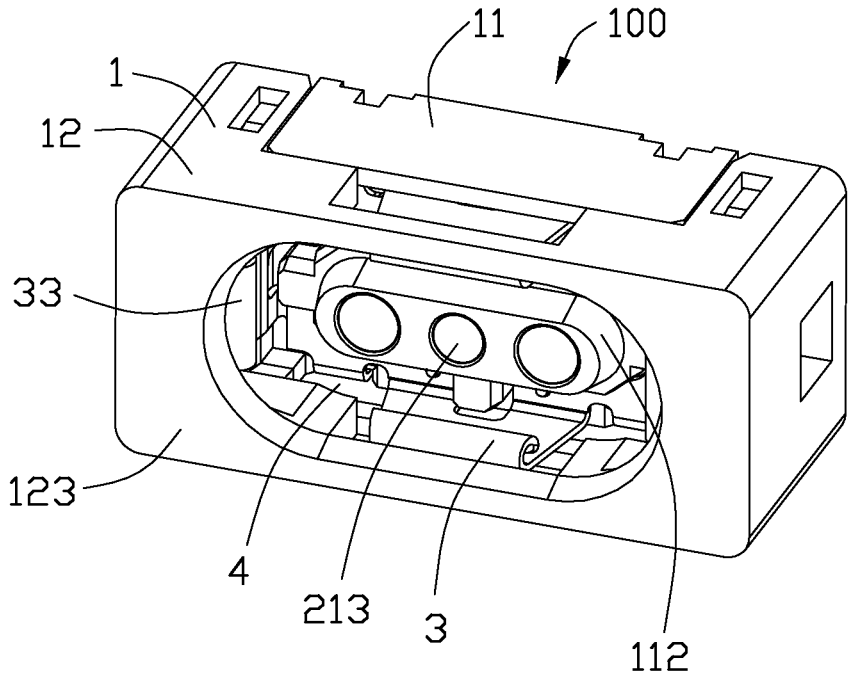
FIG. 1 is a perspective view of an electrical connector in accordance with the present invention.
Figure 2:
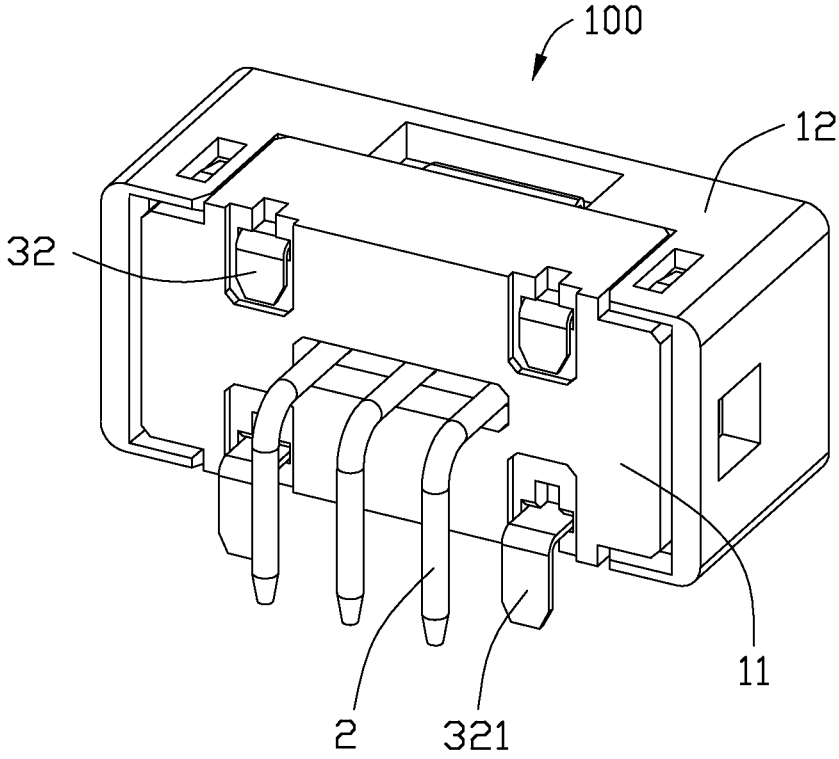
FIG. 2 is another perspective view of the electrical connector shown in FIG. 1.
Figure 4:
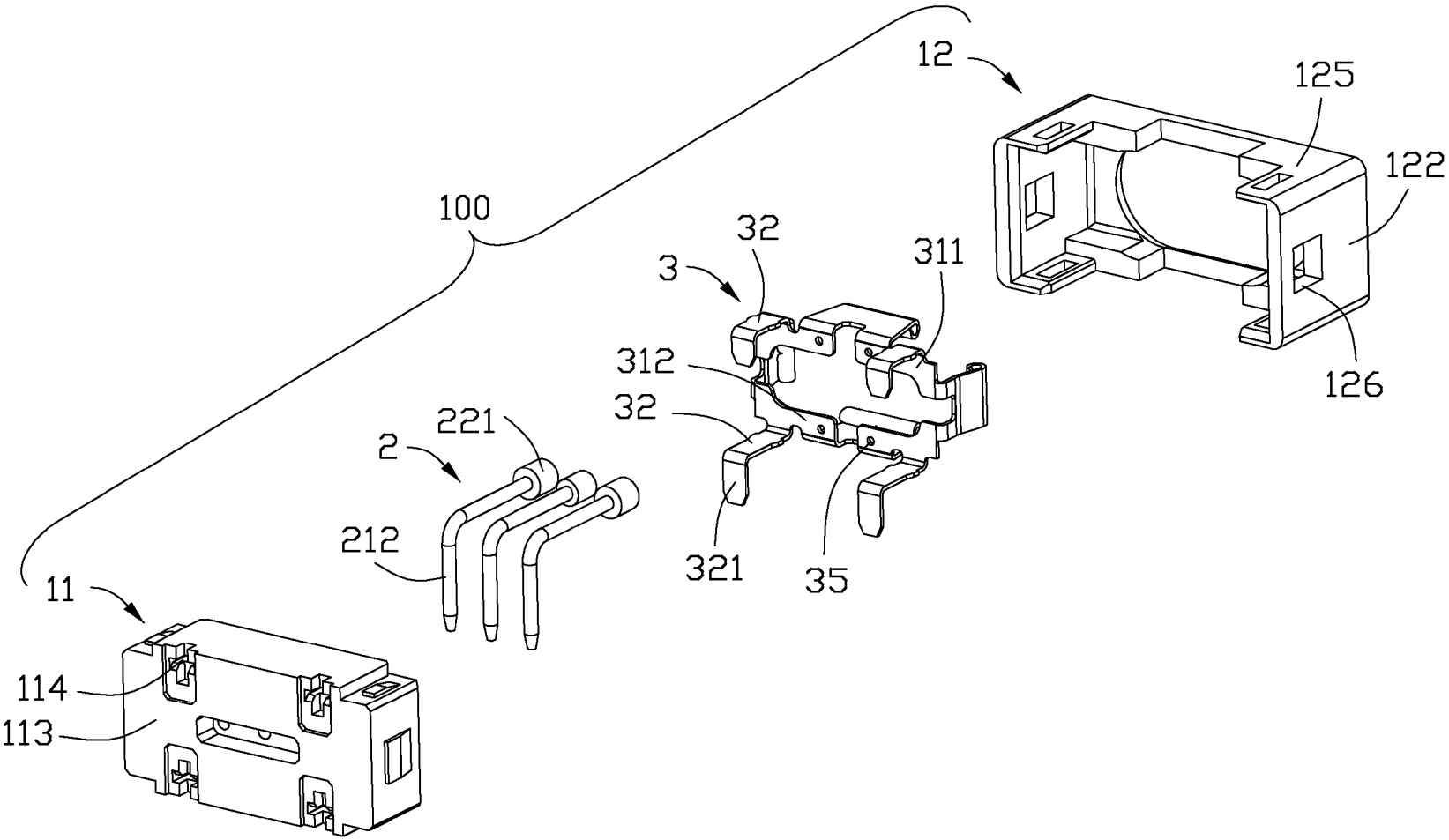
FIG. 4 is another exploded perspective view of the electrical connector shown in FIG. 3.

Reference will now be made to the drawing figures to describe a preferred embodiment of the present invention in detail. Referring to FIG. 1 and FIG. 4, the electrical connector 100 comprises a longitudinal insulative housing 1, three first contacts 2 retained in the housing 1 in this embodiment, and a resilient metallic contact or shielding 3.

Figure 3:
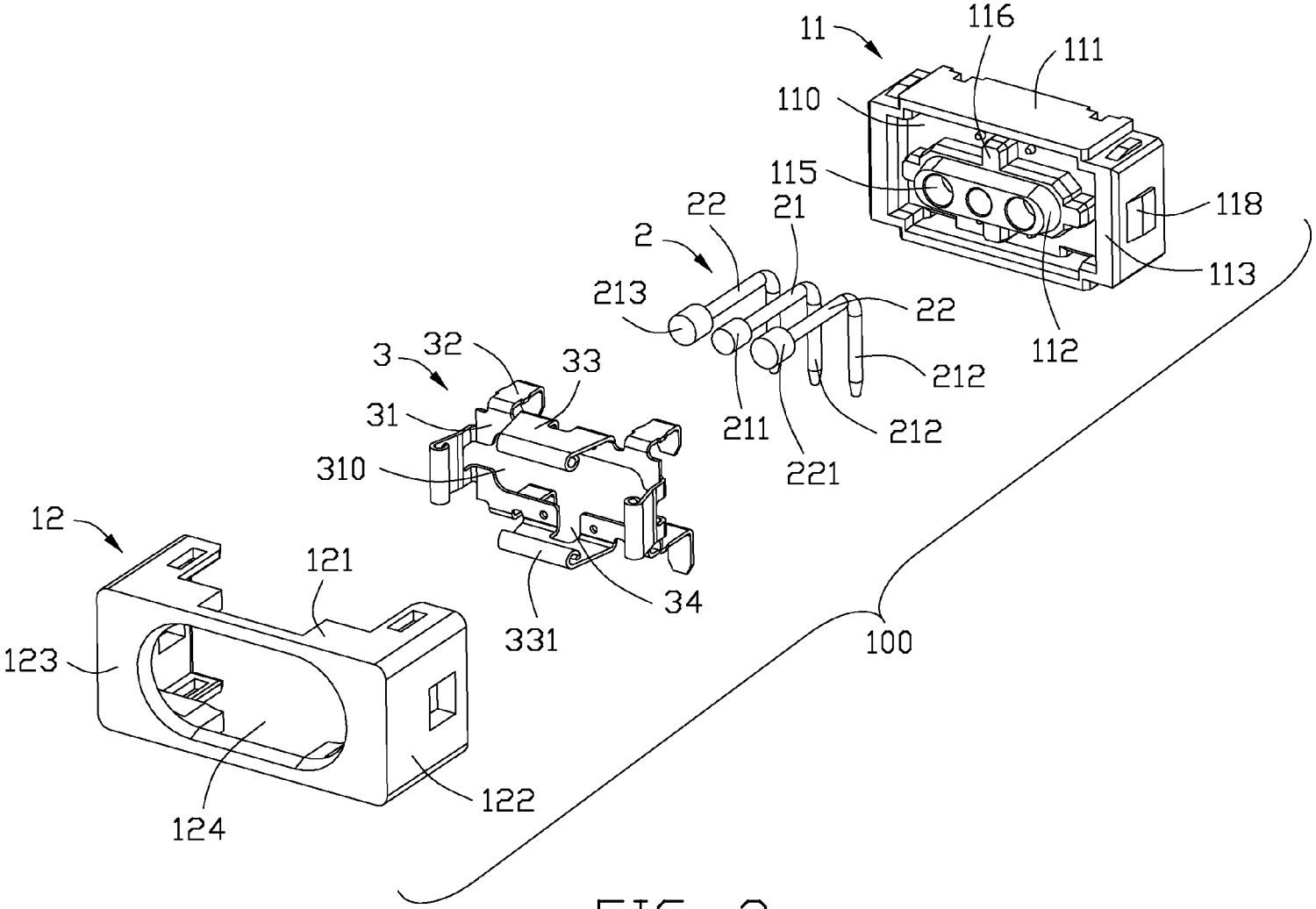
FIG. 3 is an exploded perspective view of the electrical connector shown in FIG. 1.
Figure 5:
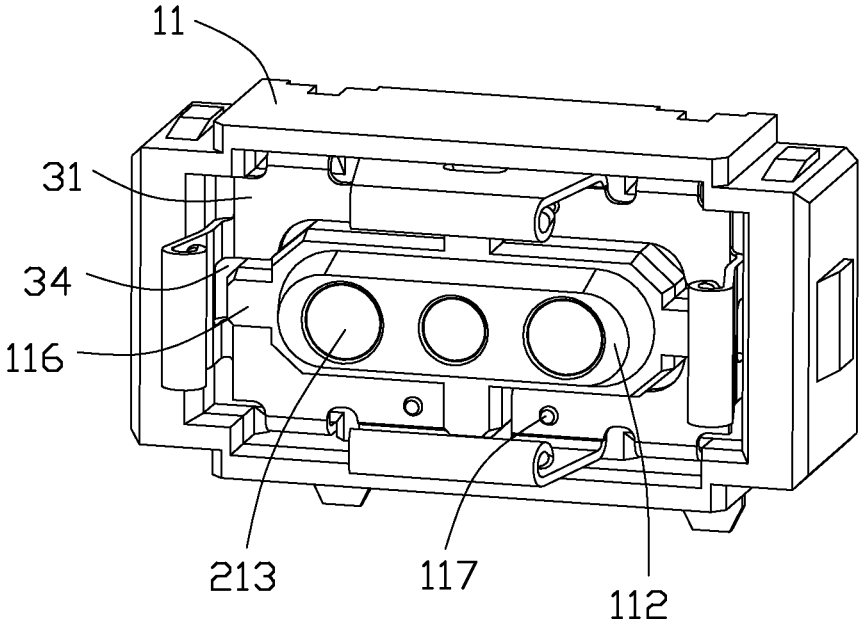
FIG. 5 is a partly perspective view of the electrical connector, showing a cover removed therefrom.

Referring to FIG. 3 to FIG. 5, the housing 1 includes a mating face 123, a blocking face 110 facing to the mating face 123, and a mating cavity 4 disposed between the mating face 123 and the blocking face 110. Description of the electrical connector 100 will be given hereinafter.

The housing 1 includes a rear base 11 and a front cover 12 latching with the rear base 11. The rear base 11 defines a main portion 111 and a raised portion 112 extending forwardly from the blocking face 110 of the main portion 111, four sidewalls 113 extend forwardly from the blocking face 110 and surround the raised portion 112. The rear base 11 defines four latching grooves 114 running through the main portion 111 at four corners thereof, three terminal grooves 115 are located in the raised portion 112 and arranged in one line along a longitudinal direction. Four retaining ribs 116 rise from the blocking face 110 to integrally connect with two sides and two ends of the raised portion 112 respectively.

The middle contact 21 of the first contacts 2 acts as a detection contact, the pair of contacts 22 neighboring the middle contact 21 act as power contacts. The three first contacts 2 have similar configuration and each defines a columned first mating portion 211, 221 and a connecting portion 212 bending rearwards and downwardly from the first mating portion 211, 221. The dimension of the first mating portion 211 of the middle contact 21 is smaller than that of the pair of contacts 22 neighboring the middle contact 21, and the first mating portions 211, 221 each defines a first contacting face 213 facing forwardly. The three first contacts 2 are inserted into corresponding terminal grooves 115 rearwards from a front portion of the rear base 11 until the first mating portions 211, 221 retained in the raised portion 112. The first contacting faces 213 expose upon the raised portion 112, and the connecting portions 212 extend out of the rear base 11.

The resilient contact 3 bents from a metal piece and acts as a grounding contact. The resilient contact 3 defines a board-shaped blocking piece/plate 31 having an opening 310 at a middle portion thereof, four retaining legs 32 bending rearwards from outer side edges of the blocking piece 31, and four latching arms 33 bending forwardly from the outer side edges and alternately arranged with the retaining legs 32. Two lower retaining legs 32 define soldering portions 321 bending downwardly. Each latching arm 33 defines a receiving slot 34 running along the blocking piece 31 to communicate with the opening 310, and a latching portion 331 crimped at a free end thereof. The blocking piece 31 further defines two retaining holes 35 disposed at two sides of the receiving slot 34 at upper and lower frames thereof. The resilient contact 3 is retained to the rear base 11 by the retaining legs 32 running through the latching grooves 114 and latching with the rear base 11. The blocking piece 31 abuts against the blocking face 110 to prevent the resilient contact 3 from moving rearward overly. The raised portion 112 projects into the opening 310 with the four retaining ribs 116 restricted in the receiving slot 34 and the retaining posts 117 ripping into the retaining holes 35 to prevent the resilient contact 3 from gliding along the blocking face 110. The receiving slot 34 may improve the resilience of the latching arm 33.

The front cover 12 defines a front wall 121 and two side walls 122 connecting with the front wall 121, each side wall 122 defines two latching board 125 respectively and oppositely extending from upper and lower side thereof. The front cover 12 is retained to the rear base 11 by the latching holes 126 latching with the latching blocks 118, the front cover 12 is rearwards assembled to the rear base 11 to form the housing 1. The mating cavity 4 run through the mating face 123 and provides an insertion hole 124 in the front wall. The latching arms 33, the raised portion 112 and the first contacting faces 213 all dispose in the mating cavity 4, and the retaining legs 32 rearwards extending out of the mating cavity 4. The resilient contact 3 synchronously acts as a grounding contact and a latching member for retaining a mating connector. The latching arms 33 of the electrical connector 100 can be easily released from the mating connector, so that the mating connector could be drawn out of the electrical connector 100 by an exterior force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating face, a blocking face behind the mating face, and a mating cavity disposed between the mating face and the blocking face, the mating cavity communicating with an exterior via an insertion hole at a front end thereof;

a plurality of first contacts arranged in the housing in a side-by-side manner, and each first contact defining a first contacting portion projecting into the mating cavity; and a resilient contact retained in the housing and defining latching arms disposed in the mating cavity;

wherein the resilient contact further defines a blocking piece abutting against the blocking face and a retaining leg extending out of the mating cavity, the latching arms extending into the mating cavity from the blocking piece; wherein the retaining leg of the resilient contact defines a soldering portion which makes the resilient contact synchronously act as a grounding contact and a latching member; wherein at least three first contacts are retained in the housing, and a middle contact of the first contacts acts as a detection contact, the pair of contacts neighboring the middle contact act as power contacts; wherein the resilient contact is a single metal piece, surrounding a body of the insulative housing; the plurality of first contacts, and the resilient contact and the insulatve housing are received in a front cover.

2. The electrical connector as described in claim 1, wherein the resilient contact defines at least two latching arms opposite to each other, and the plurality of first contacts are arranged between the at least two latching arms.

3. The electrical connector as described in claim 2, wherein each latching arm defines a receiving slot running along the blocking piece and partly disposed in the blocking piece, and a latching portion crimped at a free end thereof.

4. The electrical connector as described in claim 1, wherein the housing defines a raised portion projecting into the mating cavity from the blocking face thereof, the first contacting portions of the first contacts are retained in the raised portion and exposed at a front end of the raised portion.

5. The electrical connector as described in claim 4, wherein the blocking piece attaches to the blocking face and provides an opening at a middle portion thereof, the raised portion runs through the opening to project into the mating cavity.

6. The electrical connector as described in claim 5, wherein each latching arm defines a receiving slot running along the blocking piece to communicate with the opening, several retaining ribs integrally connected with the raised portion are received in the corresponding receiving slots.

7. An electrical connector, comprising:

a rear base loaded with at least three first contacts therein, the first contacts providing first contacting portions exposed in a middle raised portion;

a resilient contact retained in the rear base and surrounding the raised portion of the rear base, the resilient contact defining latching arms surrounding the first contacting portions; and a front cover assembled with the rear base thereby defining a mating cavity communicating with an exterior via an insertion hole defined on the front cover;

wherein the resilient contact defines a blocking piece located behind and facing to the insertion hole and a retaining leg rearwards extending from the blocking piece to latch with the rear base, the latching arms are located behind and beside the insertion hole;

wherein the retaining leg runs through the rear base and provides a soldering portion disposed outside of the rear base which makes the resilient contact synchronously act as a grounding contact and a latching member;

wherein the three first contacts are arranged in a side-by-side manner, and a middle contact of the first contacts acts as a detection contact, the pair of contacts neighboring the middle contact act as power contacts;

wherein the resilient contact is a single metal piece, surrounding the rear base; the plurality of first contacts, and the resilient contact and the rear base are received in the front cover.

8. The electrical connector as described in claim 7, wherein the front cover defines two side walls extending rearwards to be retained outside of the rear base.

9. An electrical connector comprising:

an insulative housing defining a vertical forward blocking face;

a plurality of first contacts disposed in the housing and forwardly communicating with an exterior;

a resilient contact defining a vertical frame like blocking plate abutting rearwardly against the blocking face, at least one resilient latching arm forwardly extending from a first outer edge of said blocking plate, and at least one retaining leg rearwardly extending from a second outer edge of the blocking plate; wherein said retaining leg defines an upside-down L-shaped configuration to retain the resilient contact to the housing; wherein the retaining leg of the resilient contact defines a soldering portion which makes the resilient contact synchronously act as a grounding contact and a latching member; wherein at least three first contacts are retained in the housing, and a middle contact of the first contacts acts as a detection contact, the pair of contacts neighboring the middle contact act as power contacts; wherein the resilient contact is a single metal piece, surrounding a body of the insulative housing; the plurality of first contacts, and the resilient contact and the insulatve housing are received in a front cover.

10. The electrical connector as claimed in claim 9, wherein said first outer edge and said second outer edge are closer to each other.

11. The electrical connector as claimed in claim 9, wherein said housing defines a horizontally extending slit, and the retaining leg originally extends in a straight manner to be rearwardly inserted through said slit from the blocking face and successively bent to form the final L-shaped configuration.

12. The electrical connector as claimed in claim 11, wherein said housing further defines a raised portion protruding forwardly on the blocking face, and said resilient contact defines an opening through which said raised portion extend forwardly.

13. The electrical connector as claimed in claim 12, wherein at least a rib is unitarily formed laterally with the raised portion, and the blocking plate defines a slot to receive said rib therein.

14. The electrical connector as claimed in claim 12, wherein a mating cavity is formed in front of the blocking face in which said raised portion extends forwardly.

15. The electrical connector as claimed in claimed in claim 14, wherein said mating cavity is formed by at least partially by the front cover attached upon a front face of the housing.

16. The electrical connector as claimed in claim 15, wherein a front end of the latching arm extends forwardly beyond a front face of the front cover.

* * * * *